US005397252A

United States Patent [19]

Wang

[11] Patent Number: 5,397,252

[45] Date of Patent: Mar. 14, 1995

[54] AUTO TERMINATION TYPE CAPACITIVE COUPLED CONNECTOR

[76] Inventor: Tsan-Chi Wang, 1 Fl., No. 13, Lane 312, Chung Chen Rd., Hsin Tien, Taipei Hsien, Taiwan, Prov. of China

[21] Appl. No.: 189,759

[22] Filed: Feb. 1, 1994

[51] Int. Cl.[6] ..... H01R 13/66

[52] U.S. Cl. ..... 439/620; 333/185

[58] Field of Search ..... 439/620; 333/181–185

[56] References Cited

U.S. PATENT DOCUMENTS

| | | | |
|---|---|---|---|
| 4,884,982 | 12/1989 | Kleming et al. | 439/620 |
| 4,934,960 | 6/1990 | Capp et al. | 439/620 |
| 5,062,811 | 11/1991 | Hackman | 439/620 |
| 5,108,300 | 4/1992 | Weber | 439/620 |
| 5,167,536 | 12/1992 | Wang | 333/185 |
| 5,192,230 | 3/1993 | Gabany et al. | 439/620 |
| 5,221,216 | 6/1993 | Gabany et al. | 439/620 |

*Primary Examiner*—Gary F. Paumen

*Attorney, Agent, or Firm*—Bacon & Thomas

[57] ABSTRACT

An auto termination type capacitive coupled connector for connection to a conductive panel, having a filter circuit consisted of an annular groove made around the metal body of the connector, an annular insulator mounted around the metal body of the connector and having a plurality of equiangularly spaced radial through holes, a metal ground ring fastened to the annular insulator by hooks and having a plurality of equiangularly spaced projecting strips respectively intersecting the radial through holes, and a plurality of capacitor elements respectively received in the radial through holes and connected between either projecting strip of the metal ground ring and the annular groove of the metal body of the connector.

2 Claims, 6 Drawing Sheets

AUTO TERMINATION TYPE CAPACITIVE COUPLED CONNECTOR

BACKGROUND OF THE INVENTION

The present invention relates to electrical connectors for connection to a conductive panel, and more particularly relates to an auto termination type capacitive coupled connector which when connected to a conductive panel provides a ground circuit to filter noises from entering the transmitting circuit.

U.S. patent application Ser. No. 08/085,116 discloses an improved auto termination BNC T adapter in which the male contact, the female contact, the conductive element and the ceramic resistance are connected together to form a noise blocking circuit when the BNC plug is disconnected, and therefore the effect of auto termination is achieved. However, this structure still has a drawback. When the BNC plug is connected, the ceramic resistance does no work, and the noise blocking circuit is stopped from functioning.

SUMMARY OF THE INVENTION

The present invention has been accomplished to provide a BNC type capacitive coupled connector which eliminates the aforesaid drawback. This object is achieved by providing the connector with a filter circuit. The filter circuit comprises an annular groove made around the metal body of the connector, an annular insulator mounted around the metal body of the connector and having a plurality of equiangularly spaced radial through holes, a metal ground ring fastened to the annular insulator by hooks and having a plurality of equiangularly spaced projecting strips respectively intersecting the radial through holes, and a plurality of capacitor elements respectively received in the radial through holes and connected between either projecting strip of the metal ground ring and the annular groove of the metal body of the connector. When the connector is fastened to the conductive panel and the BNC plug is connected to the connector, the auto termination circuit of the connector becomes disconnected, the metal body of the connector, the capacitor elements and the ground ring are connected to the conductive panel to form a ground circuit.

DETAILED DESCRIPTION OF THE PREFERRED EMBODIMENT

Figure 1:
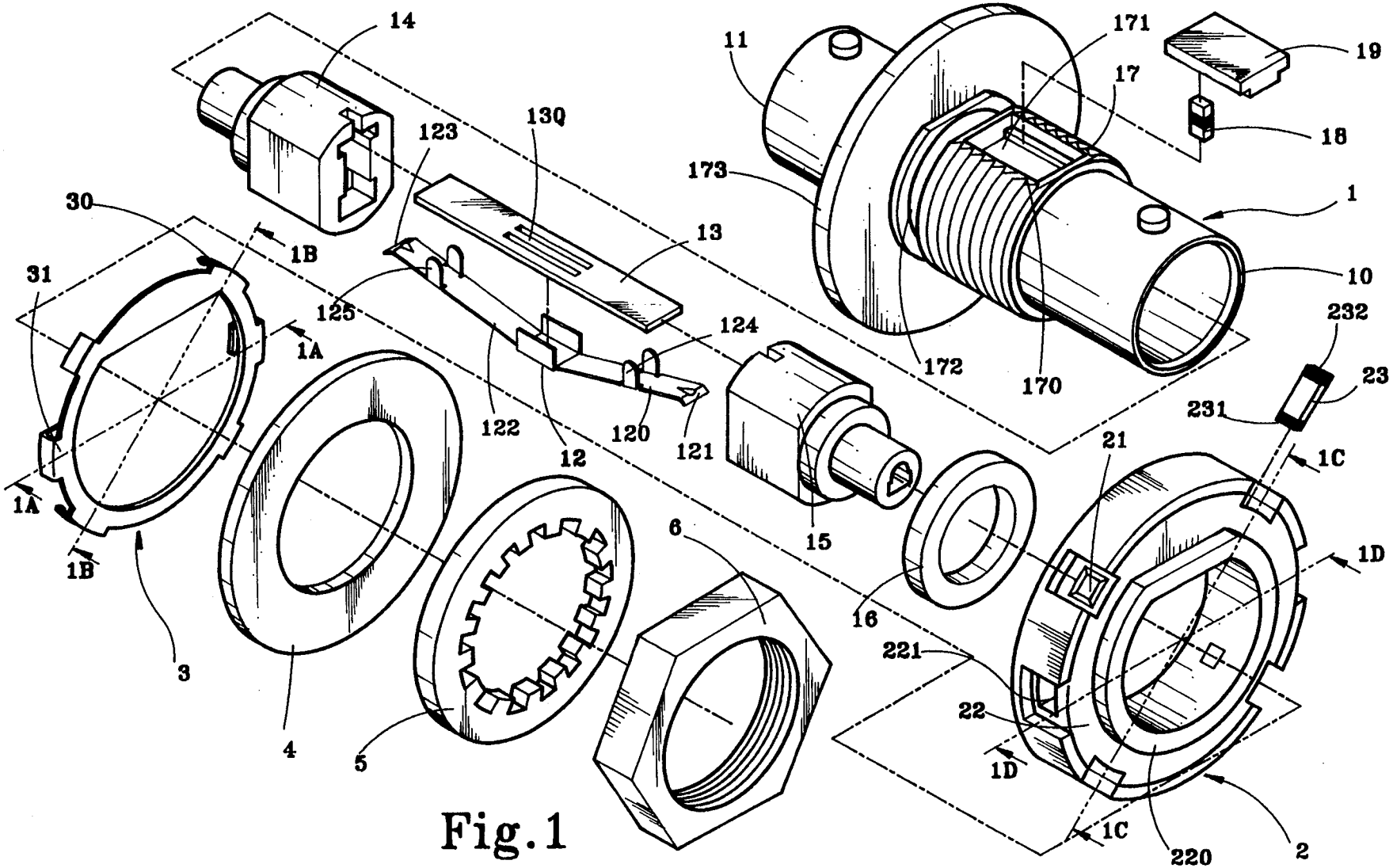
FIG. 1 is an exploded view of an auto termination type capacitive coupled connector according to the one embodiment of the present invention.
Figure 1B:
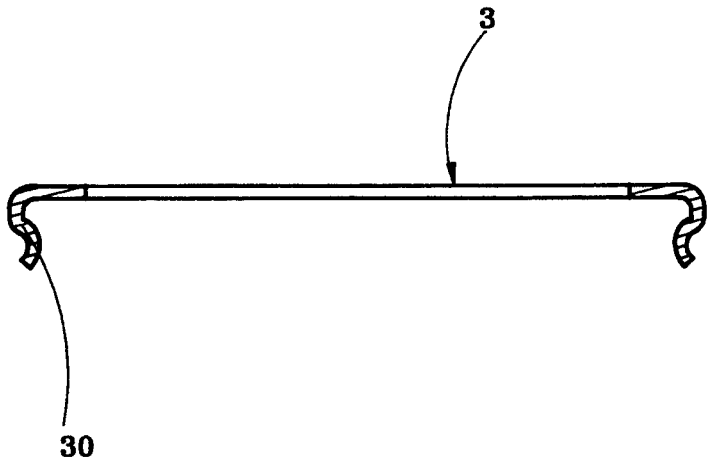
FIG. 1B is a cross section taken along line 1B—1B of FIG. 1.
Figure 1A:
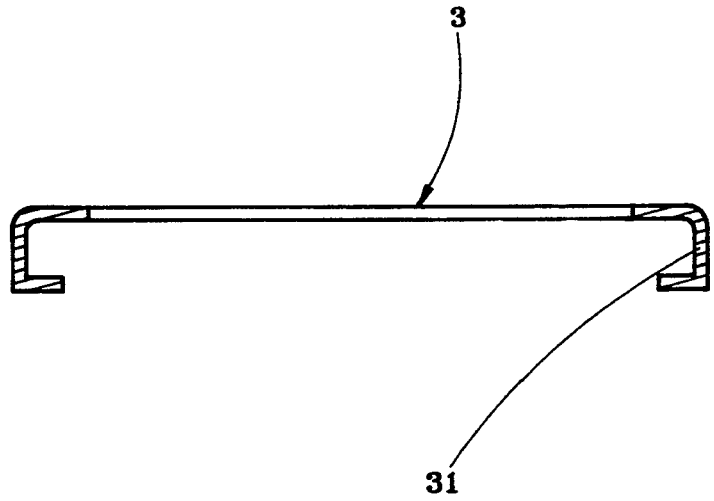
FIG. 1A is a cross section taken along line 1A—1A of FIG. 1.
Figure 1C:
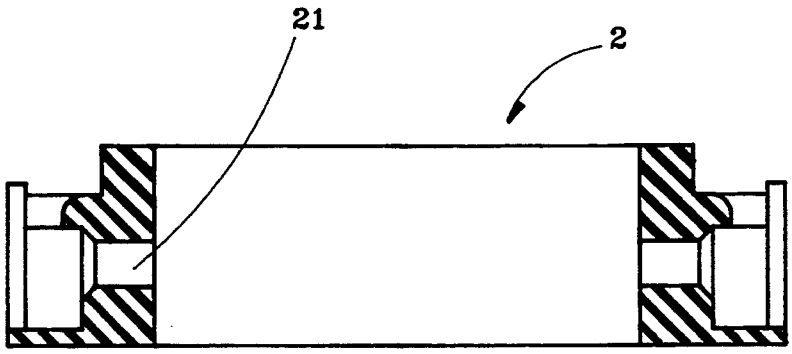
FIG. 1C is a cross section taken along line 1C—1C of FIG. 1.
Figure 1D:
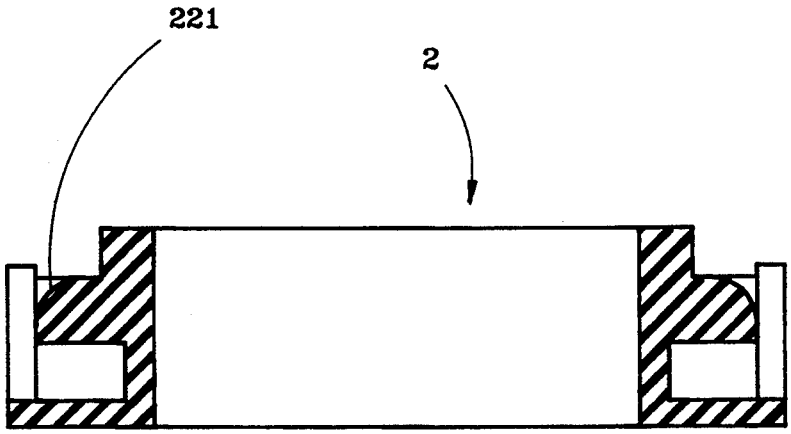
FIG. 1D is a cross section taken along line 1D—1D of FIG. 1.

Referring to FIGS. 1, 1A, 1B, 1C, and 1D, the metal connector body 1 of the auto termination type capacitive coupled connector in accordance with the preferred embodiment of the present invention comprises a first BNC jack 10 and a second BNC jack 11 at two opposite ends for connection to a respective BNC plug 7 in a computer network system, a circular radial flange 173 in the middle between the BNC jacks 10;11, an externally threaded coupling portion 17 between the radial flange 173 and the first BNC jack 10, an annular groove 172 around the outside wall between the radial flange 173 and the coupling portion 17. The coupling portion 17 has plane 170 and an opening 171 through the plane 170. A metal cover 19 is covered on the opening 171 to hold a ceramic resistor element 18. A first insulative socket member 14 and a second insulative socket member 15 are connected in series and retained inside the connector body 1 by a packing ring 16 to hold a first contact metal plate 12 and a second contact metal plate 13 on the inside at different elevations permitting the second contact metal plate 13 to contact the ceramic resistor element 18 at the bottom. Therefore, the ceramic resistor element 18 is constantly connected between the metal cover 19 and the second contact metal plate 13. The first contact metal plate 11 is for transmitting signals to the computer, comprising two bevel extensions 120;122 extended upwardly outward in the reversed directions and terminating in a respective downward guide tip 121;123, and two pairs of upright contact legs 124;125 respectively and bilaterally extended from the bevel extensions 120;122. When assembled, the upright contact legs 124;125 are constantly disposed in contact with the second contact metal plate 13.

Figure 4:
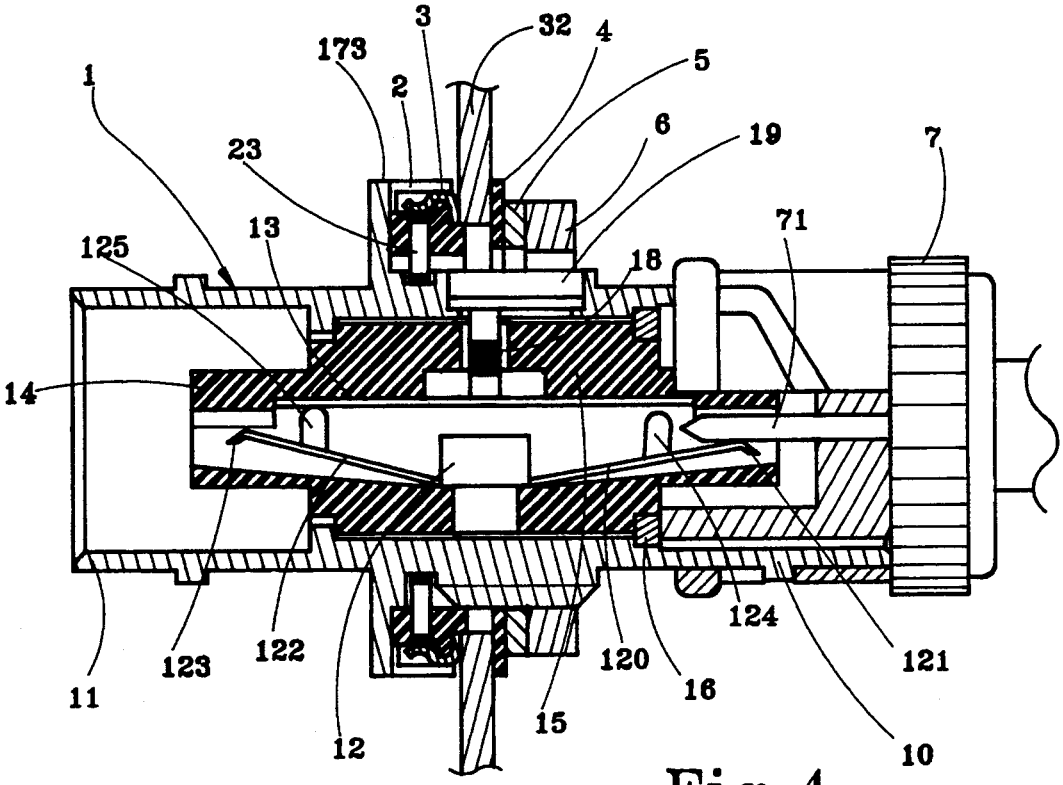
FIG. 4 is a longitudinal sectional view taken on FIG. 3, showing a BNC plug connected to the BNC jack of the, metal connector body.

Referring to FIG. 4 and FIG. 1 again, an annular insulator 2 is mounted around the annular groove 172 of the metal connector body 1. The annular insulator 2 comprises a plurality of equiangularly spaced radial through holes 21 (See FIG. 1C), which receive a respective capacitor element 23, a radial projecting wall 22 at an outer side, an outer annular flange 220 raised from the radial projecting wall 22 and covered over part of the externally threaded coupling portion 17. The capacitor element 23 in either radial through hole 21 has one end 231 disposed in contact with the wall surface of the annular groove 172 and an opposite end 232 stopped by a metal ground ring 3. Therefore, the metal connector body 1, the capacitor elements 22, and the metal ground ring 3 are connected together and formed into a filter circuit.

The metal ground ring 3 comprises a plurality of projecting strips 30 (see FIG. 1B) spaced around the border thereof and respectively inserted into a hole (not shown) on the annular insulator 2 to hold down either capacitor element 23, and a plurality of unitary hooks 31 (see FIG. 1A) respectively spaced between either two projecting strips 30 and hooked on the chamfered peripheral edge 221 (see FIG. 1D) of the radial projecting wall 22 of the annular insulator 2.

Figure 2A:
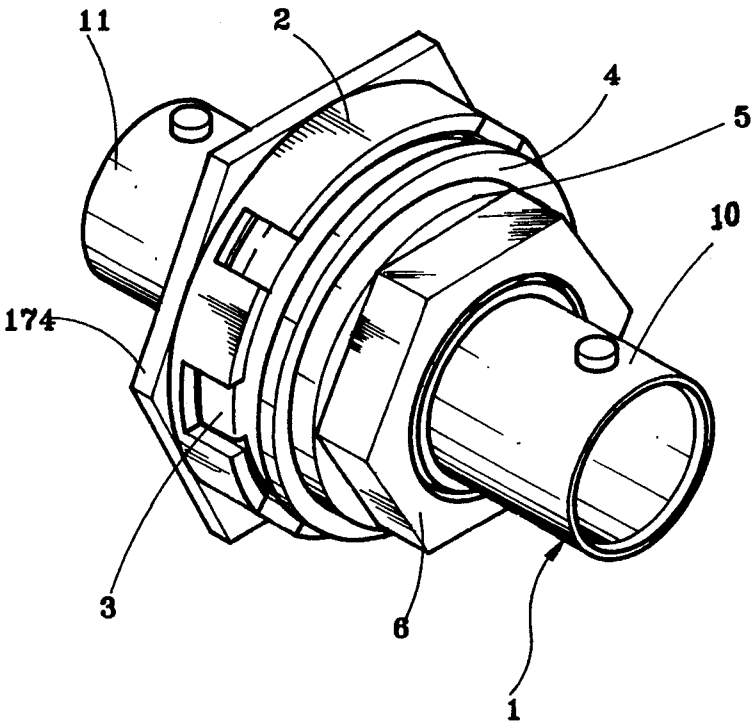
FIG. 2A is similar to FIG. 2 but showing an alternate form of the radial flange on the metal connector body.

The radial flange 173 on the metal connector body 1 shown in FIG. 1 is made of circular shape. As an alternative form of the present invention, the radial flange shown in FIG. 2A, referenced by 174, is made of hexagonal shape.

Figure 5:
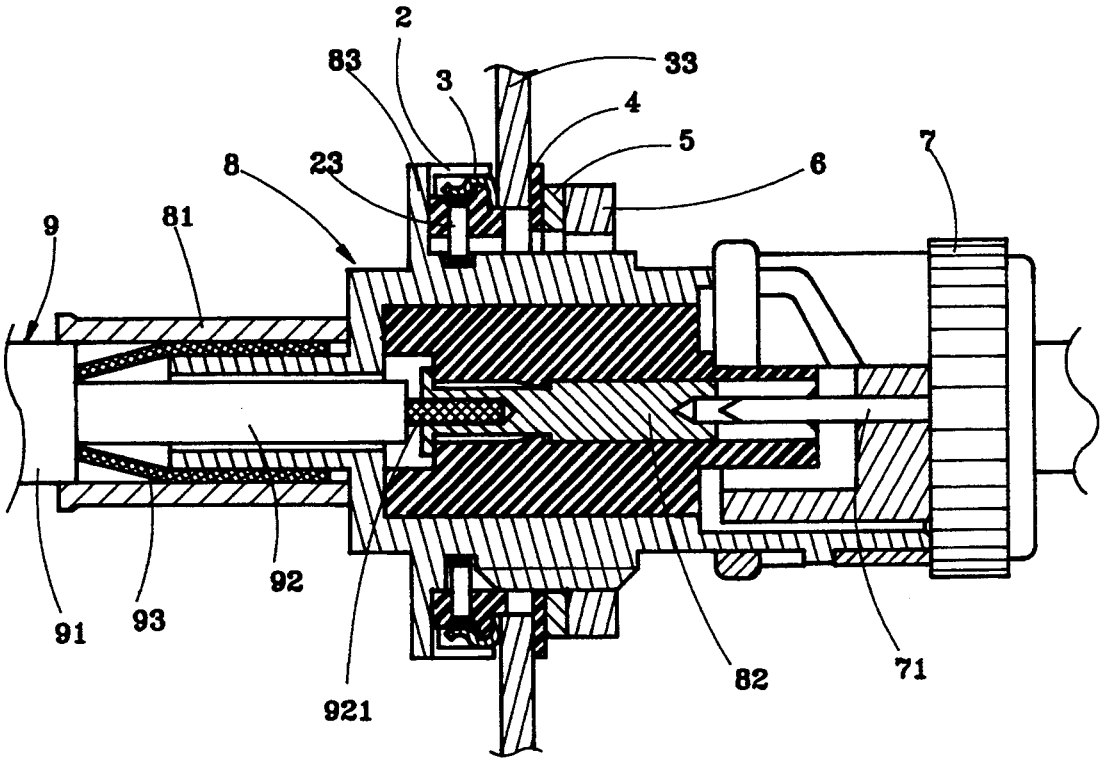
FIG. 5 is a longitudinal sectional view of an alternate form of the present invention.

Referring to FIGS. 4 and 5, the filter circuit of the metal connector body 1 eliminates the interference of radio waves from the computer PC panel 32 or conductive mounting panel 33 (see FIGS. 4 and 5). When the externally threaded coupling portion 17 of the metal connector body 1 is inserted through the mounting hole (not shown) on the PC panel 32, an insulative ring 4, an internally toothed cushion ring 5, and a nut 6 are respectively mounted around the externally threaded coupling portion 17 of the metal connector body 1 in proper order permitting the PC panel 32 to be retained between the annular insulator 2 and the insulative ring 4, and the ground ring 3 to be retained in contact with the PC panel 32. Therefore, noises from the panel 4 can be eliminated by the capacitor elements 22. The arrangement of the insulative ring 4 is to insulate the filter circuit from the PC panel 32 so as to prevent signal interference.

Referring to FIG. 4 again, when the BNC plugs 7 are disconnected from the BNC jacks 10;11, the first and second contact metal plates 12;13 and the ceramic resistor element 18 are connected together and formed into an auto termination circuit. When the BNC plugs 7 are respectively connected to the BNC jacks 10;11, the center contact 71 of each BNC plug 7 respectively forces down the bevel extensions 120;122 of the first contact metal plate 12 causing the contact legs 124;125 disconnected from the second contact metal plate 13, and therefore the auto termination circuit is disconnected. When the auto termination circuit is disconnected, the metal connector body 1, the capacitor elements 23, and the ground ring 3 form into a filter circuit to eliminate noise signal. The filter circuit further combines with the PC panel 32 into a ground circuit.

Figure 2:
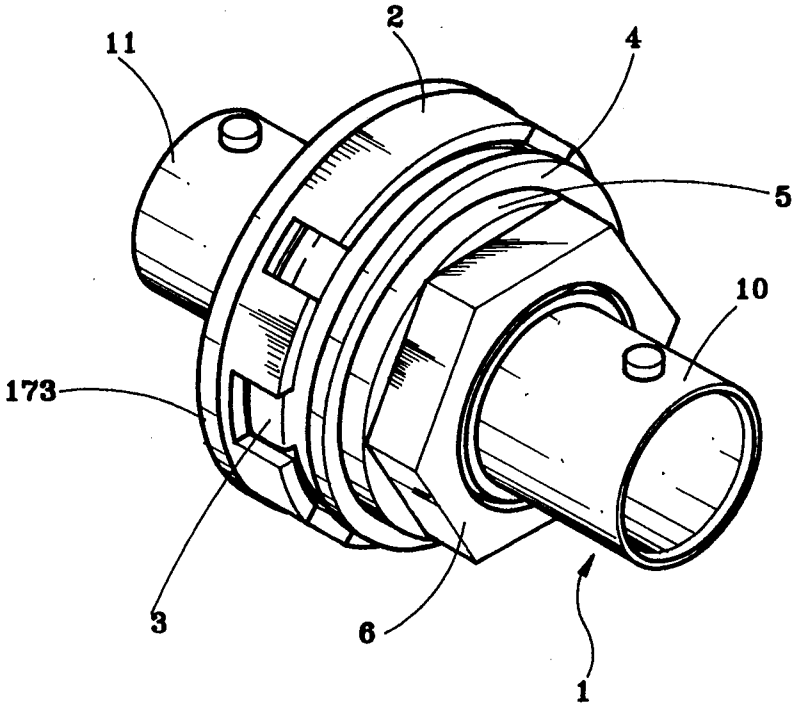
FIG. 2 is an elevational view of the auto termination type capacitive coupled connector shown in FIG. 1.
Figure 3:
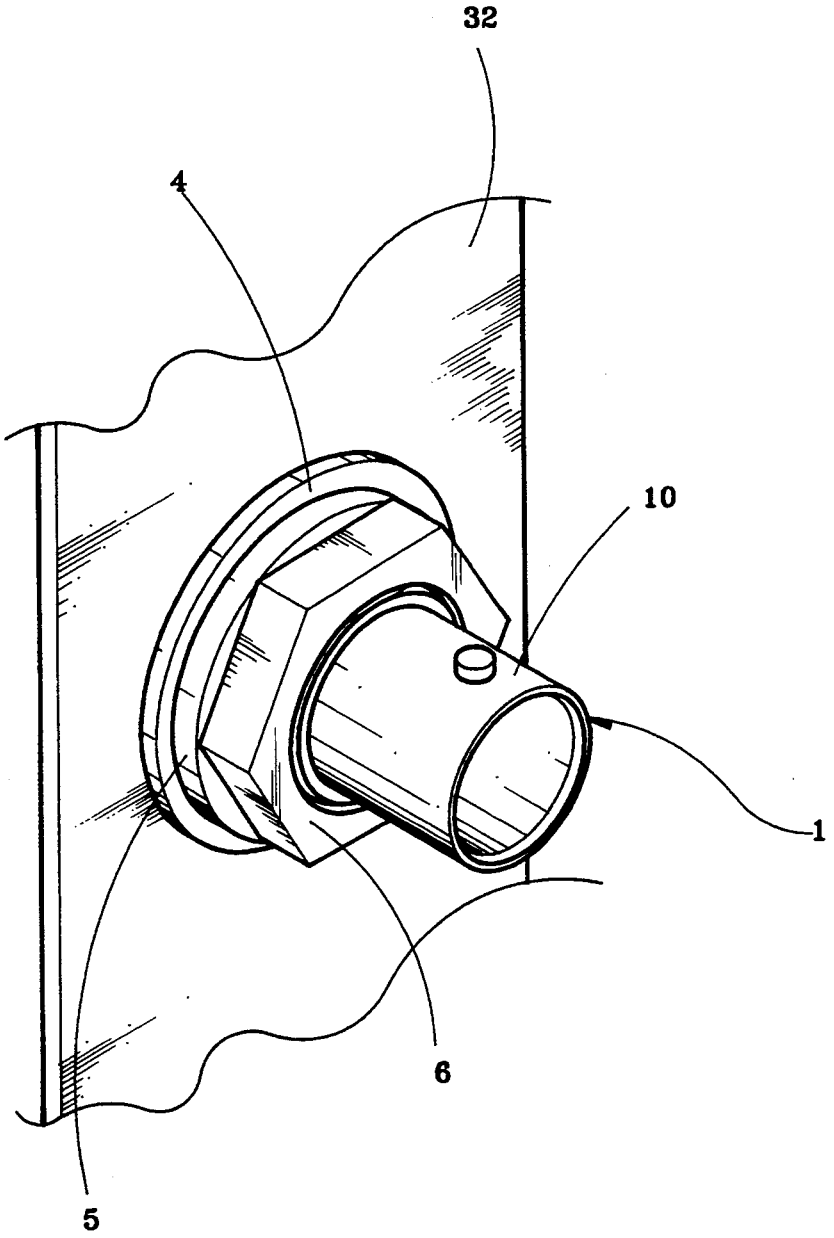
FIG. 3 shows the auto termination type capacitive coupled connector of FIG. 2 mounted on a conductive panel.

Referring to FIG. 5, therein illustrated is and one-way BNC jack 8 according to an alternate form of the present invention. The BNC jack 8 is fastened to a conductive wall panel 33, having one end connected to a BNC plug 7 and an opposite end connected to a coaxial cable 9. The outer insulator 91 of the coaxial cable 9 is stripped off, the outer conductor 93 (the negative terminal of the signal line) is fastened to the metal body of the BNC jack 8 by a binding tube 81, and the inner insulator 92 is inserted into the BNC jack 8 permitting the center conductor 921 (the positive terminal of the signal line) to contact the contact metal element 82 of the BNC jack 8. The center conductor 921 is peripherally embossed so that it becomes firmly retained in contact with the contact metal element 82 when inserted. Similar to the connector shown in FIG. 2, the BNC jack 8 comprises a circular radial flange 83 and is mounted with an annular insulator 2, a ground ring 3, an insulative ring 4, an internally toothed cushion ring 5, and a nut 6. The capacitor elements 23 in the annular insulator 2, the ground ring 3, and the metal body of the BNC jack 8 form a filter circuit to eliminate noises. When the BNC jack 8 is fastened to the conductive wall panel 33, the filter circuit and the conductive wall panel 33 form into a ground circuit.

While only two embodiments of the present invention have been shown and described, it will be understood that various modifications and changes could be made without departing from the spirit and scope of the invention.

I claim:

1. An auto termination type capacitive coupled connector comprising a metal connector body and a filter circuit, said metal connector body having a radial flange around the periphery thereof, a BNC jack at one end for connecting a BNC plug, and an externally threaded coupling portion between said radial flange and said BNC jack for connection to a conductive panel by an internally toothed cushion ring and a nut, wherein said filter circuit comprises:

an annular groove made around the outside wall of said metal connector body and disposed between said radial flange and said externally threaded coupling portion;

an annular insulator mounted around said externally threaded coupling portion and covering said annular groove, said annular insulator comprising a plurality of equiangularly spaced radial through holes, a radial projecting wall at an outer side, an outer annular flange raised from said radial projecting wall and covering part of said externally threaded coupling portion;

a plurality of capacitor elements respectively received in one of said radial through holes on said annular insulator, each capacitor element having one end disposed in contact with said annular groove of said metal connector body; and a metal ground ring fastened to said annular insulator to hold down said capacitor elements, said metal ground ring comprising a plurality of projecting strips spaced around the border thereof and respectively inserted into a said hole on said annular insulator to hold down a respective said capacitor element permitting the capacitor element to be connected between said metal ground ring and said annular groove of said metal connector body, and a plurality of unitary hooks respectively spaced between adjacent said projecting strips and hooked on the border of said radial projecting wall.

2. The auto termination type capacitive coupled connector of claim 1 wherein said radial projecting wall of said annular insulator has a chamfered peripheral edge on which said hooks of said metal ground ring are hooked.

* * * * *